United States Patent [19]

Yamamoto et al.

[11] Patent Number: 4,795,073

[45] Date of Patent: Jan. 3, 1989

[54] STAPLER WITH DETACHABLE STAPLE HOLDER

[75] Inventors: Ken Yamamoto; Shuhei Kageyam, both of Saitama, Japan

[73] Assignee: Kotobuki & Co., Ltd., Japan

[21] Appl. No.: 896,676

[22] Filed: Aug. 14, 1986

[30] Foreign Application Priority Data

Aug. 23, 1985 [JP] Japan ..... 60-129353[U]

[51] Int. Cl.[4] ..... B25C 5/11

[52] U.S. Cl. ..... 227/120; 227/156

[58] Field of Search ..... 227/120, 127, 128, 156

[56] References Cited

U.S. PATENT DOCUMENTS

| | | | |
|---|---|---|---|
| 2,520,909 | 9/1950 | Cavanagh | 227/128 |
| 2,667,638 | 2/1954 | Segal | 227/120 |
| 2,680,245 | 6/1954 | Marano | 227/120 |
| 4,040,556 | 8/1977 | Dahle | 227/120 |
| 4,405,073 | 9/1983 | Escalante | 227/156 X |
| 4,496,091 | 1/1985 | Yasuda | 227/120 |
| 4,546,909 | 10/1985 | Ebihara | 227/120 |
| 4,556,161 | 12/1985 | Oide | 227/120 |

*Primary Examiner*—Frank T. Yost

*Assistant Examiner*—James L. Wolfe

*Attorney, Agent, or Firm*—David O'Reilly

[57] ABSTRACT

A stapler comprised of a base body having an anvil at one end, a staple holder having a slot at one end in the vicinity of an end wall and a staple block consisting of many staples positioned between said wall and a pushing spring, a pushing body having a staple pushing plate at one end for extruding staples one by one through said slot, the other ends of said base body and staple holder being connected by a connecting shaft so that said holder may be positioned between said bodies, the end of the staple holder being detachably connected to the shaft. The base body may also be connected to the pushing body through a resilient connecting part material so as to form a splay mouth, with the return spring being formed integrally on the base body and/or pushing body and a projection provided to contact the top of said integral spring. A guide member may be provided on an upper bottom face of the holder, with the outer face of the guide member constructed to guide a staple block. A spring receiver is inserted in a center hole in the guide member and a staple block pushing seat is provided on the spring receiver.

6 Claims, 8 Drawing Sheets

STAPLER WITH DETACHABLE STAPLE HOLDER

FIELD OF THE INVENTION

This invention relates to a stapler for stapling paper and pamphlets for government, companies, shcools and the like.

BACKGROUND OF THE INVENTION

FIG. 3 is a perspective view of conventional stapler in an opened position.

In FIG. 3, base body 2 has an anvil 1 at its end. A staple holder 8 of metal has a slot 4 at its end. A guide bar 20 is inserted between its front receiver (not shown) and a receiver 8*b* provided at a rear port of the inner face of the holder 8. A staple pushing plate 13 is slidably inserted on the guide bar 20. A staple pushing spring 5 is inserted on the guide bar 20 between the staple pushing plate 13 and receiver 8*b* for pushing a staple block 7 of many staples 6 toward the end wall 3. A handle 15 is provided on the upper face of the pushing plate 13.

A pushing body 10 having staple pushing plate 9 for pushing the staples one by one through slot 4. A spring receiver 21 is inserted at the upper part of the staple holder 8 and its end engages a bore 9a of pushing plate 9.

Opposite side plates of the base body 2, staple holder 8 and pushing body 10 are connected by a shaft 11 and the rear end of the spring receiver 21 (not shown) contacts the shaft 11.

A return spring 18 is attached to the inner face of the base body 10 and a return spring 19 is attached to the inner face of the base body 2.

In this conventional device, for loading staples 7, the body 10 and spring receiver 21 are disengaged from the upper part of the staple holder 8 and pushing plate 13 is retracted to the rear direction against the force of spring 5; then the staple block 7 is inserted into the staple holder 8. Releasing the staple pushing plate 13 causes the plate 13 to slide from rear to front by the force of spring 5 and push the staple block 7 to the front end wall 3.

After loading with staples, the body 10 and the spring receiver 21 are engaged to the upper part of the staple holder 8. For stapling, papers are inserted between the anvil 1 of the base body 2 and the slot 4 of the staple holder 8; then the staple holder 8 and pushing body 10 are pressed down and rotated about the shaft 11. Pushing plate 9 pushes a staple 6 at the front end of the staple block 7 against the resilient force of the spring 18, causing a staple 6 to depart from the staple block 7 and extruded from the slot 4 to pierces the papers. The ends of the staple 6 are bent by the anvil 1 inwardly to staple the papers.

Then the pushing body 10 is released, it is retracted from the holder 8 by the force of spring 18, releasing pushing plate 9. At the same time the staple holder 8 and pushing body 10 are also returned by the force of spring 19 so as to perform stapling continuously.

However, in said conventional device, the operation for loading staples is a complicated and troublesome operation.

BRIEF DESCRIPTION OF THE INVENTION

The purpose of the present invention is to provide a stapler to load staples easily and rapidly. For resolving said problems, in this invention, a stapler comprises a base body having an anvil at it end, a staple holder having a slot at its end in the vicinity of an end wall and a staple block consisting of many staples between said wall and a pushing spring, and a pushing body having a staple pushing plate at its end for extruding staples one by one through said slot. The ends of said base body and staple holder are connected by a connecting shaft so that the holder is positioned between said bodies, characterized in that the end of the staple holder is detachably connected to the shaft. In the stapler, the rear end of the staple holder detachably engages the shaft so that it is possible to exchange a loaded staple holder with an empty staple holder in the stapler when all the staples are consumed.

Another object of this invention is to provide a stapler in which the construction is simple and staples can be loaded more easily.

The above and other objects, advantages and novel features of the invention will be more fully understood from the following detailed description and the accompanying drawings, in which like reference numbers indicate like or similar parts throughout wherein;

BRIEF DESCRIPTION OF THE DRAWINGS

FIG. 9 (*b*) shows a cross sectional view of receiver 51 in the sixth embodiment.

DETAILED DESCRIPTION OF THE INVENTION

Figure 1:
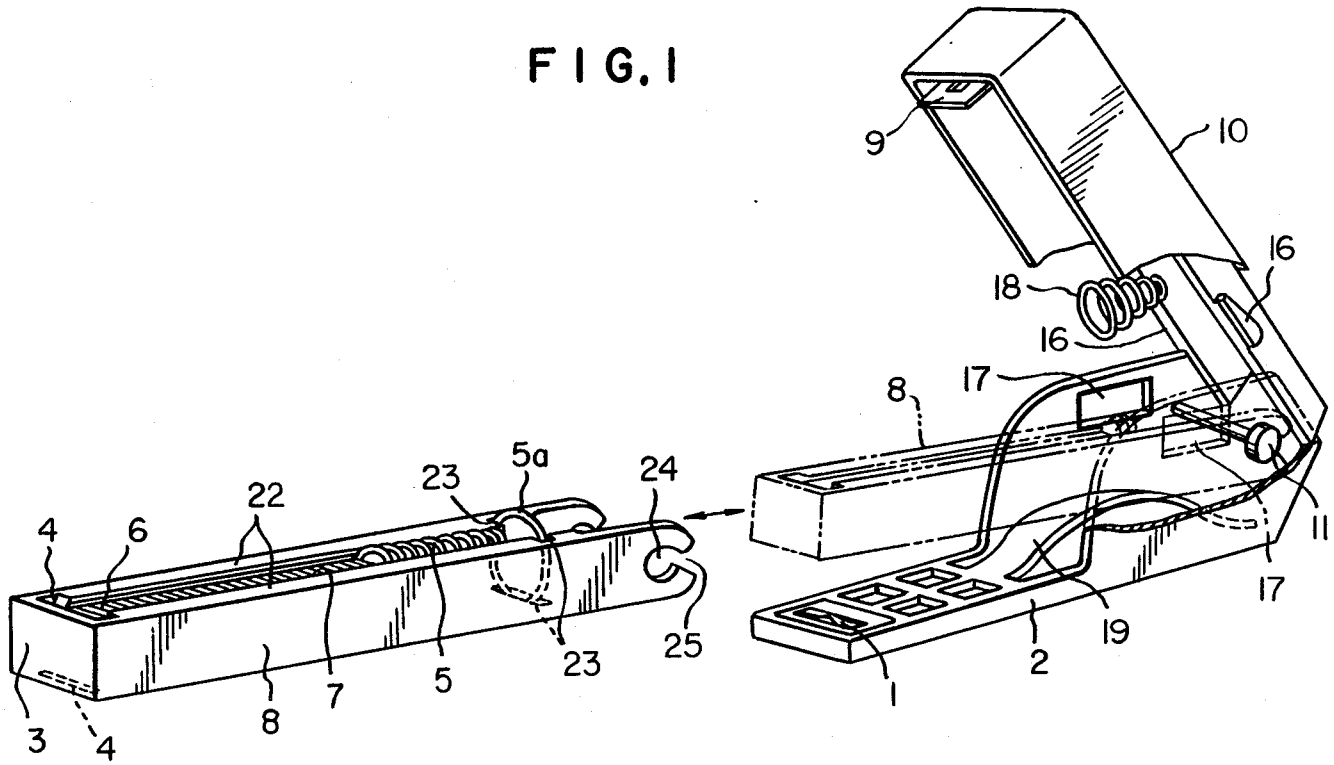
FIG. 1 shows a perspective view of an embodiment of this invention is an opened position.

In FIG. 1, a base body 2 has an anvil 1 at its front end, and a staple holder 8 of plastic having a slot 4 for extruding a staple at the front end in the vicinity of front well 3. A pair of spring guides 22,22 are provided along the upper edges along opposite sides along the staple holder 8, having a recess 23 provided at the rear part of the guide 22 for receiving a spring 5.

The rear end of the staple holder 8 opens for inserting a staple block 7 and the spring 5 contacts the rear end of the staple block 7 with the enlarged rear end 5*a* of spring 5 engaging recess 23 so that the spring 5 can push the staple block 7 toward the front end. Engaging bores 24,24 are provided at the rear end of the side walls of the staple holder 8, with bores 24,24 having notches 25,25 for engaging and inserting shaft 11.

Pushing body 10 has a pushing plate 9 for pushing staples 6 one by one through slot 4.

Side walls on opposite sides of base body 2 and pushing body 10 are connected by shaft 11 engaging bores 24,24 on the opposite side walls of staple holder 8 and are detachably connected to the shaft 11 by notches 25,25. Engaging projections 16,16 are formed at the outer face of the side walls of the pushing body 10 for engaging parts 17,17 provided on the side walls of the base body 1.

A return spring 18 is attached to the inner face of the pushing body 10 and return spring 19 is attached to the inner face of the base body 2.

The operation of the device is as follows.

For stapling papers, inserted between the anvil 1 of the base body 2 and the slot 4 of the staple holder 8, the staple holder 8 and pushing body 10 are pressed down and rotated about shaft 11, causing pushing plate 9 to push a staple 6 at the front end of the staple block 7 against the resilient force of the spring 18. The staple 6 departs from the staple block 7 and is extruded from the slot 4 and pierces the papers. Then ends of staple 6 are bent by the anvil 1 inwardly to staple the papers.

Then, the pushing body 10 is released, causing it to retract from the holder 8 by the force of spring 18, also retracting pushing plate 9. At the same time the staple holder 8 and pushing body 10 are also returned by the force of spring 19 to permit stapling continuously.

When all staples 6 are consumed, pushing body 10 is opened by disengaging the projections 16,16 from the engaging parts 17, 17. A pull on the staple holder 8, causes the notch 25 to open and the empty staple holder 8 can be removed from the shaft 11. Then a new staple holder 8 loaded with staples 6 is inserted between bodies 2,10 and the notch 25 of the new staple holder 8 is pushed on to shaft 11. The notch 25 opens allowing the engaging bore 24 to engage with the shaft 11 and new staple holder 8 is connected to the shaft 11.

Figure 2:
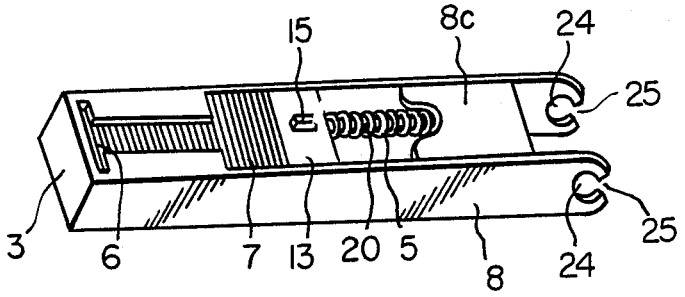
FIG. 2 shows a staple holder of a second embodiment of this invention.
Figure 3:
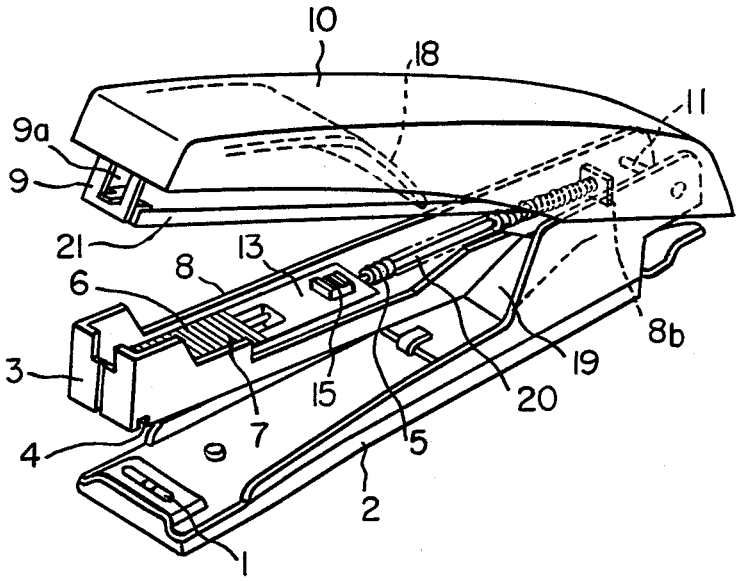
FIG. 3 PRIOR ART
FIG. 3 shows a perspective view of conventional staples in an opened position.

In this invention, a staple holder of plastic can be used. FIG. 2 shows a second embodiment of this invention. In this embodiment, a spring receiver **8*c* receives return spring 18 and guide bar 20. The remaining construction is the same as that of FIG. 1. As explained above in this invention an empty staple holder 8 can be exchanged with a new staple holder 8 can be easily exchanged with a new staple holder 8 because the staple holder 8** is detachably connected to the shaft.

Figure 4:
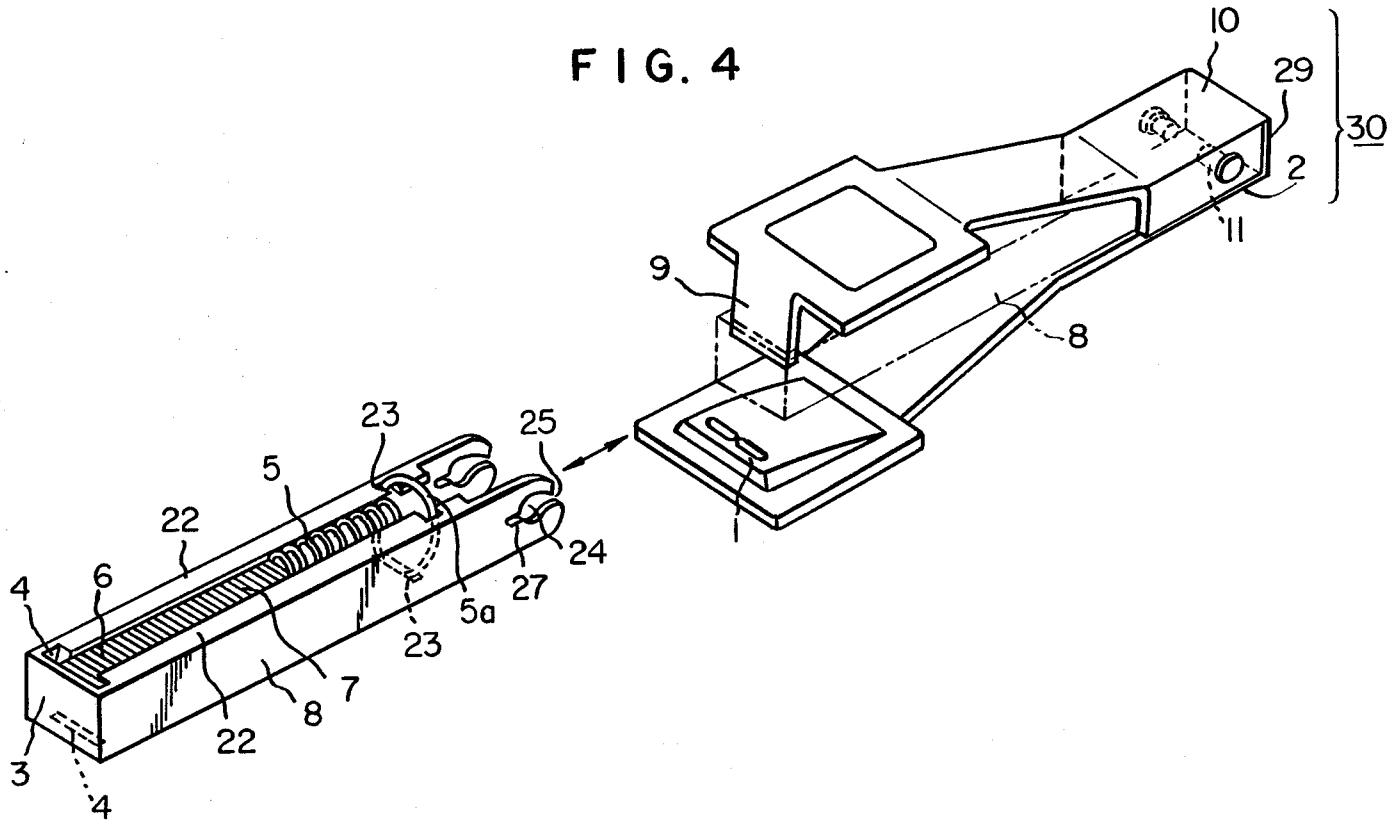
FIG. 4 shows a perspective view of a third embodiment of this invention in an opened position.

FIG. 4 shows a third embodiment of this invention. In this figure the same numerals show the same parts as the first and second embodiments and only the different part is explained. The rear part of base body 2 is connected to the rear part of the pushing body 10 by a connecting part 29 of resilient material so as to form a splay mouth 30. The shaft 11 is supported on opposite side walls of the pushing body 10.

In this embodiment, return spring 19 in the previous embodiments can be eliminated because connecting part 29 serves the same function as a return spring 19.

Figure 5:
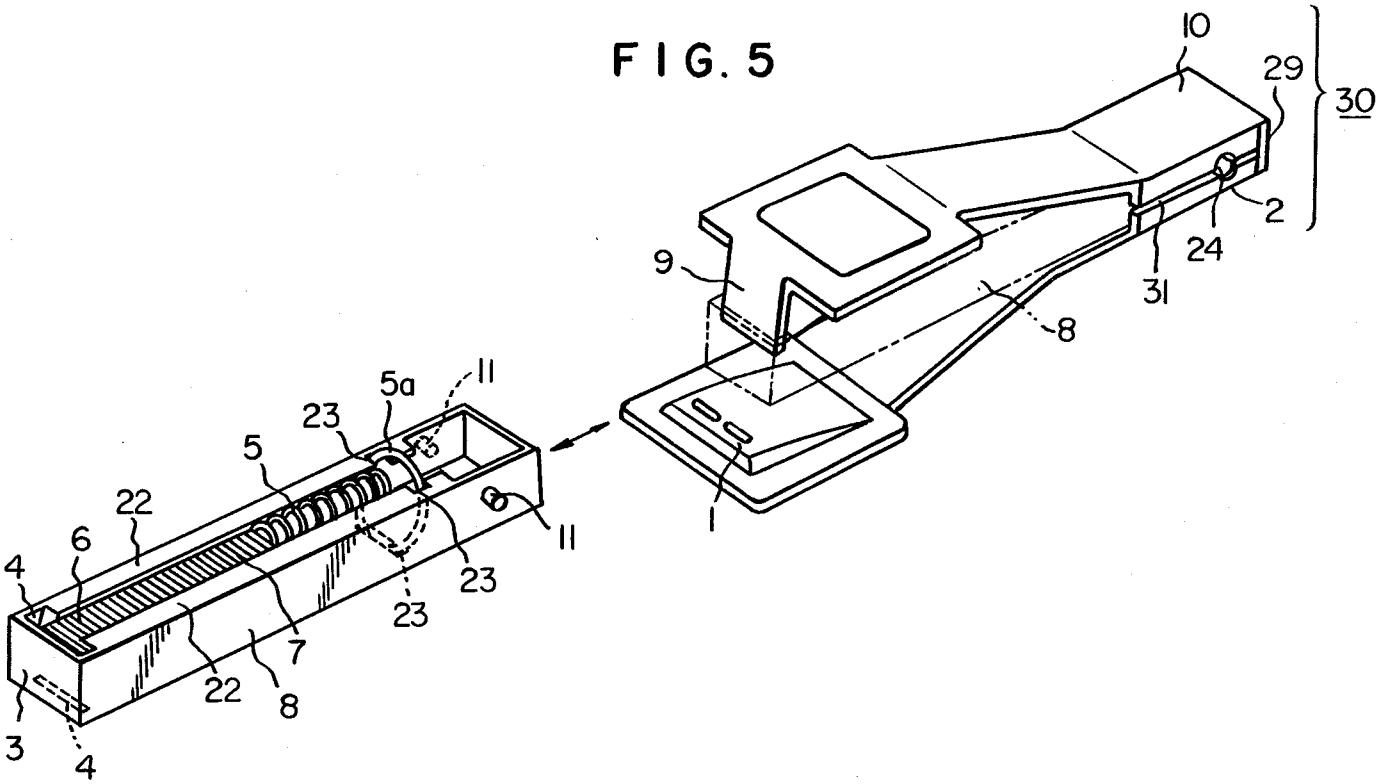
FIG. 5 shows a perspective view of a fourth embodiment of this invention.

FIG. 5 shows the fourth embodiment of this invention in which the same numerals show the same parts as the third embodiment and only the different part is explained. The splay mouth 30 is a resilient material made of metal by press machining or plastic by injection molding. Opposite side walls at the rear ends of said bodies 2, 10 oppose and form an engaging bore 24 and passage 31 for the shaft 11 to fit between them. The shaft 11 is formed on the opposite side walls of the staple holder 8.

As shown in dotted lines the shaft 11 of the holder 8 is supported by engaging bore 24 so as to rotate and be easily pulled through passage 31 when the holder is pulled in a forward direction when empty of staples 6. A new holder loaded with new staples 6 can be set easy in operation by inserting shaft 11 into passage 31 until it engages bore 24.

Figures 6, 7:
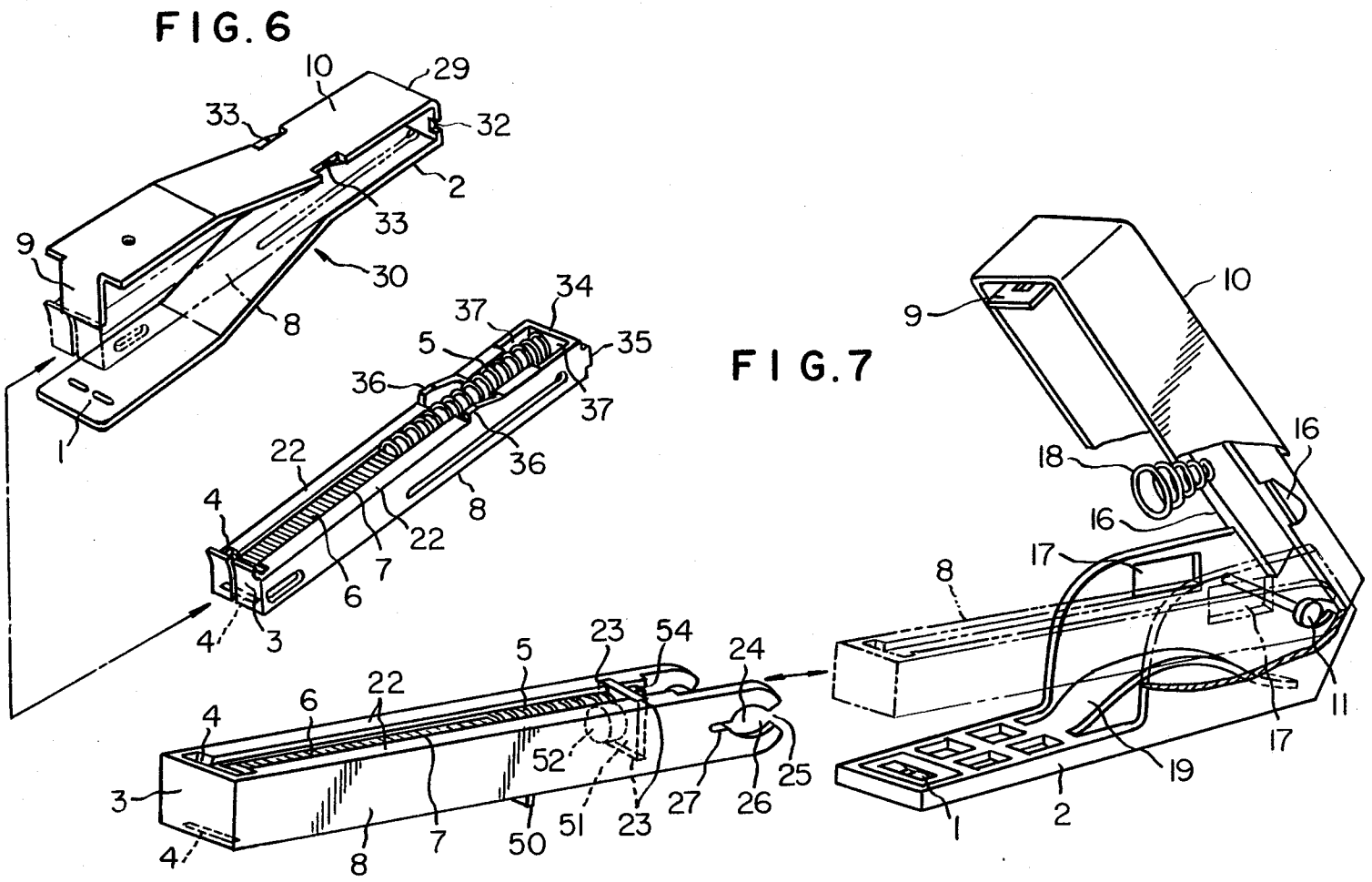
FIG. 6 shows a perspective view of a fifth embodiment of this invention.
FIG. 7 shows a perspective view of a sixth embodiment of this invention.

FIG. 6 shows a fifth embodiment of this invention in which the connecting part 29 has notches 32, 32 on opposite side edges and projections 35, 35 formed on the rear wall 34 of the holder 8. The pushing body 10 has notches 33,33 on opposite side edges and projections 36,36 formed on the upper edges of the holder 8.

As shown in the dotted line, projections 35,35 and 36,36 of the holder 8 engage notches 32,32 and 33,33 respectively and holder 8 can be exchanged easily.

The holder 8 has recesses 37,37 at its rear end for inserting or picking up spring 5 in a compressed state in the holder 8.

In said third to fifth embodiments, staples 6 in the holder 8 are guided by spring guide 22, so pushing plate 13, guide bar 20 and receiver **8*b* for the guide bar 20, etc may be eliminated, more staples in than a conventional stapler may be loaded so that holder 8 is simple and may be disposable. Bodies 2,10** may be covered by plastics of beautiful and various designs.

Figure 8:
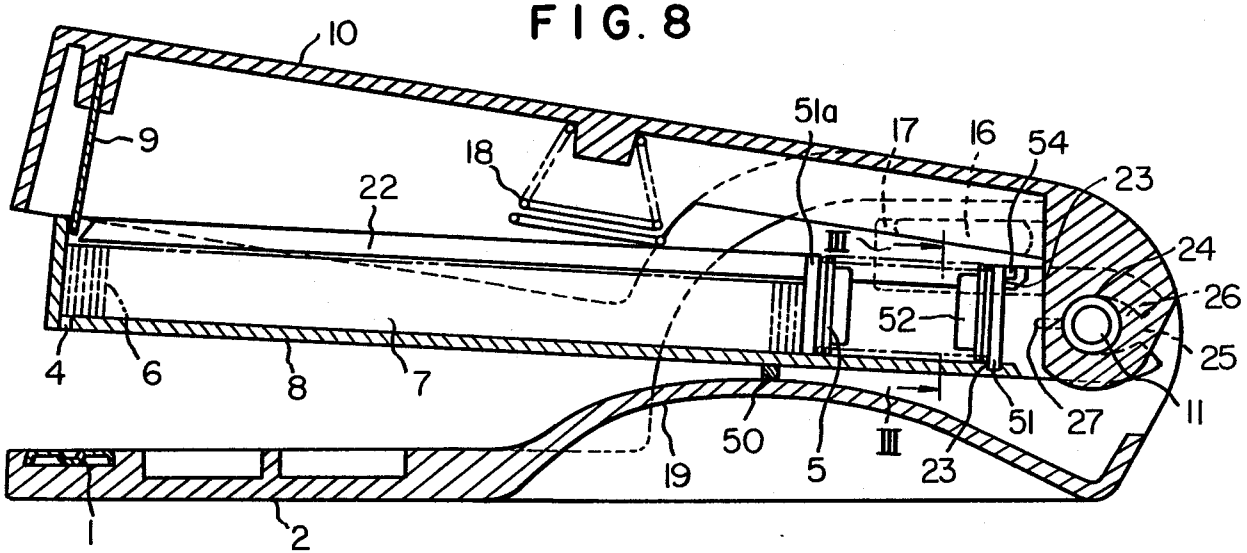
FIG. 8 shows a cross sectional view in a longitudinal plane of the sixth embodiment of this invention.
Figure 9B:
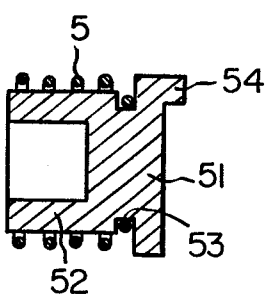
FIG. 9 (*a*) shows a cross sectional view along line III—III in FIG. 8.
Figure 9A:
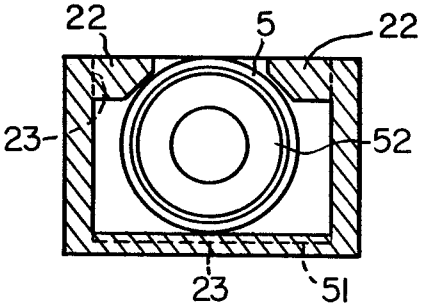

FIGS. 7 through 9 show a sixth embodiment of this invention in which the same parts a previous embodiments are shown by the same numerals and only different parts are explained. The return spring 19 is integrally formed in the bottom plate of base body 2 in an upward arched shape. A projection 50 is provided at the bottom face of the holder 8 to contact the top of said spring 19 for increasing Young's constant of the spring 19. The projection may be provided on top of the spring 19. Spring 18 may be of the same construction as the return spring 19.

In this embodiment, the return spring 19 and/or spring 18 are integrally formed in the base body 2 and/or pushing body 10 so that the construction becomes simple and can be assembled easily.

A spring receiver 51 inserted in the recess 23 has a projection 52 for mounting on the end of staple pushing spring 5. As shown in FIG. **9*b*, the end of the spring 5 engages recess 53 in receiver 51. Spring receiver 51*a* (FIG. 8) has the same shape as receiver 51. Projection 54 is for handling the receiver 51. For loading the staples 6 into holder 8, staple pushing spring 5 is compressed by receiver 51,51*a* and removed from holder 8**.

Figure 10:
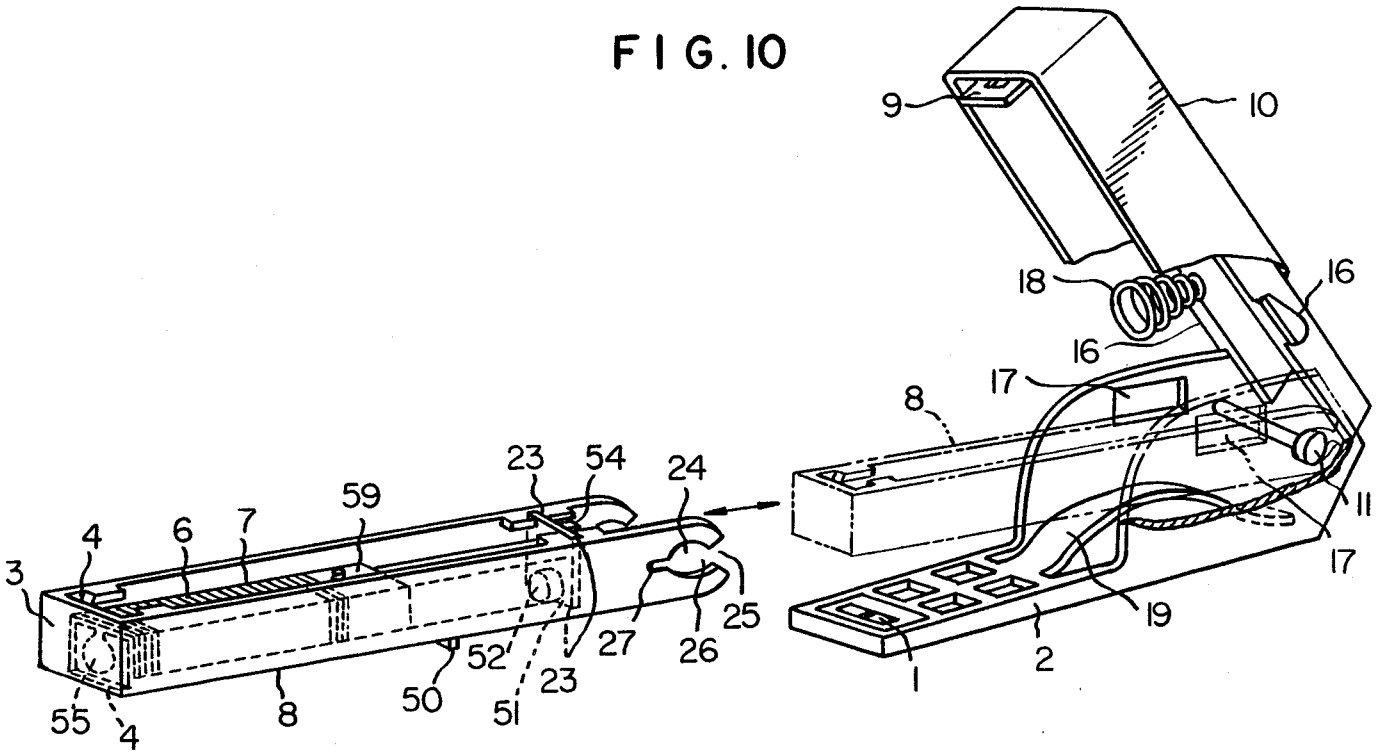
FIG. 10 shows a perspective view of a seventh embodiment of this invention.
Figure 11:
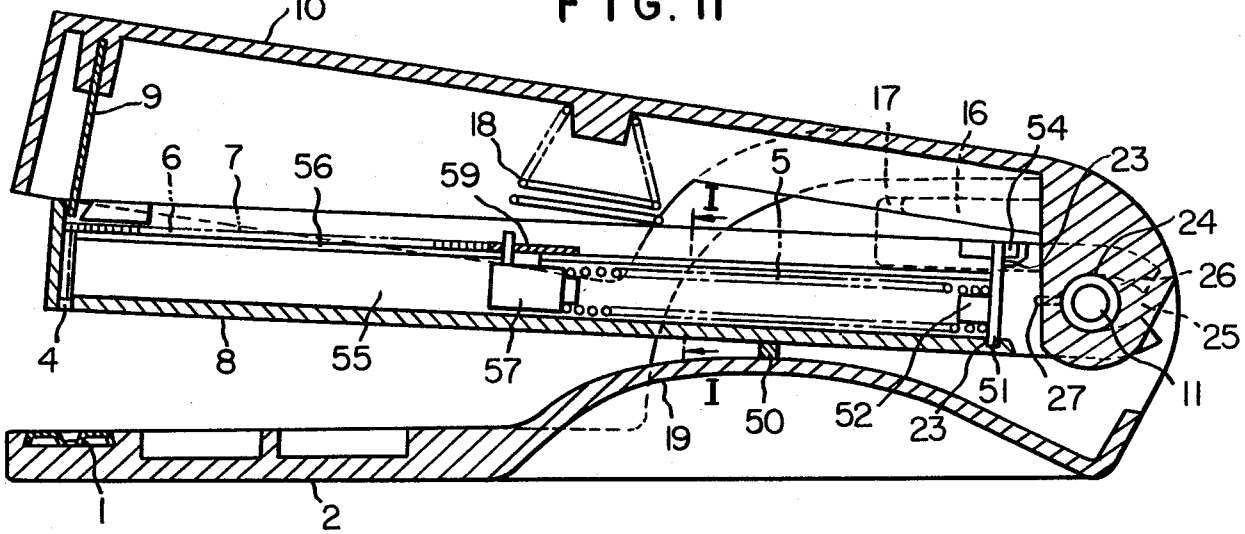
FIG. 11 shows a cross sectional view along a longitudinal plane of the seventh embodiment.
Figure 12:
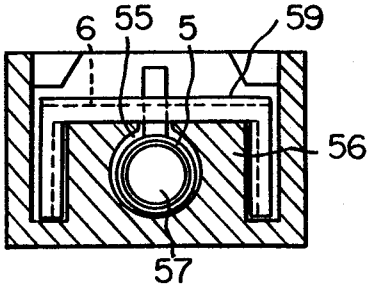
FIG. 12 shows a cross sectional view along line I—I of FIG. 11.

FIGS. 10 to 12 show a seventh embodiment of this invention in which the same parts a previous embodiment have the same numerals and only different parts are explained. As shown in FIG. 12, a guide member 56 is provided on the inner and bottom face of the holder 8 and has a center hole 55. The outer face of the guide member 56 tends to guide staple block 7. A spring receiver 57 is inserted in the center hole 55, the staple pushing spring 5 is inserted between the receiver 51 and 57 (FIG. 11). A staple pushing seat 59 is provided on receiver 57 passing through center hole 55. The spring seat 59 contacts the rear end of staple block 7.

In this embodiment, staple block 7 can be loaded into the holder by sliding the receiver 57 back against the force of spring 5. The staple pushing seat 59 is moved along the longitudinal direction of guide member 56 by receiver 57 is center hole 55 without deflecting from the guide member 56 and contacts and pushs staple block 7 accurately. Moreover, spring 5 does not deflect from the holder because it is partly inserted into the center hole and inserted between receivers 51 and 57 which is also inserted into center hole 55. Especially, guide member 56 is firmly positioned on the bottom face of holder 8 and may not move lateraly. The guide member 56 may be formed integral with holder 8 by plastic injection moulding.

What is claimed is:

1. A stapling device having a detachable staple holding means comprising; a base body having an anvil at one end of said base body; a pushing body having staple pushing plate means mating with said anvil on one end of said pushing body; hinge means hingedly connecting said base body and said pushing body together at the ends opposite said anvil end and pushing plate end; at least one pushing spring holding said anvil end and said staple pushing plate in a spaced apart relationship; detachable staple holding means having an end wall, side walls and a bottom; a narrow slot in said bottom adjacent said end wall; a plurality of staples in said staple holding means; a resilient staple pushing spring holding said plurality of staples against said end wall adjacent to said slot so that an end of said pusher plate can force a staple through said narrow slot against said anvil when a force is applied to press said pushing body down toward said base body; means on the end of said detachable staple holding means opposite the end having said narrow slot for detachably mounting said detachable staple holding means between said pushing body and said base body; said detachable mounting means including means on the end of said detachable staple holding means opposite the end having said narrow slot for detachably coupling said staple holding means to said hinge means; said detachable coupling means comprising bore means on the end of said staple holding means opposite said end having said narrow slot; deformable slot means accessing said bore means; said hinge means including shaft means for engaging said bore means so that said shaft means may be pushed into said bore means through said deformable slot means to detachably secure said detachable staple holding means on said base body and said pushing body; whereby said detachable staple holding means may be completely removed from between said pushing body and said base body for refilling with staples and then reattached to said hinge means with said narrow slot properly positioned to dispense staples.

2. The device according to claim 1 in which said hinge means includes an integrally formed resilient connecting portion on the other ends of said base body and pushing body opposite the ends having the anvil and pushing plate respectively; said resilient connection portion also forming said at least one pushing spring.

3. The device according to claim 2 including a wall adjacent the end of said detachable staple holding means opposite said narrow slot; said wall holding said staple pushing spring in place behind said plurality of staples whereby said plurality of staples are pushed toward said narrow slot.

4. The device according to claim 1 including; spring receiving means engaging a rear end of said staple pushing spring; said spring receiving means constructed to hold said staple pushing spring in an aligned position in said staple holding means.

5. The device according to claim 4 including; a second spring receiving means in said staple holder engaging a forward end of said staple pushing spring; said second spring receiving means constructed to abut and push said plurality of staples in a straight line toward said narrow slot.

6. The device according to claim 5 including; guide means on a surface of the bottom of said detachable staple holding means; said guide means shaped to slidably receive and guide said plurality of staples and said second spring receiving means in a straight line.

* * * * *